United States Patent [19]

Nordquist

[11] Patent Number: 5,012,712

[45] Date of Patent: May 7, 1991

[54] TOOL HOLDER FOR PUNCHING TOOLS

[75] Inventor: Bengt H. Nordquist, Täby, Sweden

[73] Assignee: Pullmax AB, Goteborg, Sweden

[21] Appl. No.: 338,604

[22] Filed: Apr. 14, 1989

[30] Foreign Application Priority Data

Apr. 25, 1988 [SE] Sweden ..... 8801527

[51] Int. Cl.[5] ..... B21D 28/02; B26F 1/04

[52] U.S. Cl. ..... 83/571; 83/549; 83/588; 83/618; 83/687; 83/698

[58] Field of Search ..... 83/549, 552, 571, 588, 83/698, 618, 687

[56] References Cited

U.S. PATENT DOCUMENTS

| | | | |
|---|---|---|---|
| 3,765,291 | 10/1973 | Stenfeldt | 83/563 |
| 4,206,667 | 6/1980 | Hirata et al. | 83/698 X |
| 4,220,052 | 9/1980 | Blanz | 83/549 X |
| 4,250,785 | 2/1981 | Morishita et al. | 83/552 |
| 4,555,966 | 12/1985 | Klingel | 83/71 |
| 4,569,267 | 2/1986 | Klingel | 83/552 |
| 4,623,089 | 11/1986 | Scott | 83/571 X |
| 4,646,604 | 3/1987 | Schink | 83/698 |
| 4,779,329 | 10/1988 | Nordquist et al. | 29/568 |

FOREIGN PATENT DOCUMENTS

| | | |
|---|---|---|
| 131267 | 6/1902 | Fed. Rep. of Germany . |
| 134371 | 10/1919 | United Kingdom . |

*Primary Examiner*—Hien H. Phan

*Attorney, Agent, or Firm*—Davis Hoxie Faithfull & Hapgood

[57] ABSTRACT

A tool holder for a punching machine includes a housing attached to the frame of the machine for the purpose of accommodating a punch holder with a number of punches capable of actuation as required. The housing is essentially coaxial with the cutter slide of the machine. The punches are arranged with equal spacing around a pitch circle which is coaxial with the cutter slide and the housing, and eccentrically in relation to the cutter slide. Extending directly in line with each punch is a push-rod, which is supported in such a way as to permit its axial movement inside the housing in parallel with the common axis of the housing and the cutter slide. Each push-rod is so arranged as to be actuated by an impact heel capable of rotating relative to the housing about the axis of the latter. By transmitting the punching force from the cutter slide via the impact heel and the push-rod to the punch, the position of which has been adjusted by the relative rotation of the housing and the impact heel, the punch holder is relieved of eccentrically acting forces and is capable of accepting an increased number of punches in return for a corresponding increase in its diameter, without impairing the guiding of the punches.

3 Claims, 3 Drawing Sheets

TOOL HOLDER FOR PUNCHING TOOLS

The present invention relates to a tool holder for punching tools with a number of punches capable of actuation as required intended for a punching machine, including a housing which is essentially coaxial with the cutter slide of the punching machine for the rotation-free accommodation and the axially movable control of a punch holder connected to the cutter slide with a number of axially movable punches situated eccentrically around the axis of the housing and so arranged as to be actuated individually so as to interact with die openings in a die part adapted to the punches.

SE 8604196-9 presents a tool holder for a punching machine so arranged as to accommodate a punch holder (cassette tool) connected to the cutter slide of the machine with a number of punches situated eccentrically around the axis of the tool holder, each of which punches can be activated so as to interact with a correspondingly adapted die part. In this arrangement the punching force is transferred from the cutter slide of the machine via the punch holder to the activated eccentrically situated punch. The tool holders of the punching machine are so arranged as to interact with tools arranged in pairs in a turret magazine. Where use is made of punch parts and die parts, both containing a number of punches for the purpose of interacting with corresponding die openings in the die part, a very large number of punching tools can be accommodated in the turret magazine without causing the diameter of the magazine to increase to an excessive degree, which is a disadvantage especially with regard to the fact that the time taken to advance a desired tool to the change-over position is increased to an inconvenient degree.

It is thus desirable for the largest possible number of tools to be contained in a turret magazine of modest dimensions. The aforementioned cassette tool with a number of interacting punches and die openings offers one solution in this case. However, it is not directly possible to house too great a number of punches in a cassette tool in a tool holder without certain disadvantages emerging. If the number of punches in the tool is increased, there will be a corresponding increase in the eccentricity of the punches relative to the common axis of the tool and the cutter slide. This means that a punch in the working position will apply an inconveniently high moment in a plane passing through the punch and the aforementioned axis of the tool, which is associated with a certain degree of elasticity in the punch, such that its guiding in relation to the interacting die opening is impaired.

The object of the invention is to make available a tool holder for accommodating a cassette tool with a plurality of punches, in conjunction with which the necessary correct guiding of the punches is also afforded when the cassette tool is so arranged for reasons of capacity as to accommodate a relatively large number of punches, with the associated increase in the eccentricity of the punches.

This object of the invention is achieved through a tool holder of the kind described by way of introduction having the characteristics in accordance with the accompanying Patent Claim 1.

Every eccentric influence acting against the punch holder of the tool is eliminated through the arrangement of force-transmitting push-rods between the cutter slide of the machine and the working punch. The eccentric loading which, on the other hand, occurs at the impact heel on the cutter slide of the machine, has no influence on the guiding of the punch and can be absorbed without difficulty by the cutter slide with its stable mounting in the frame of the machine.

The desired punch is activated by causing the impact heel to rotate relative to the housing for the tool holder with its push-rods about the common axis of the push rod/tool holder. This can be achieved either by causing the impact heel to rotate about the cutter slide with the tool holder stationary, or by rotating the tool holder for both the punch part and the die part simultaneously about said axis whilst the impact heel is mounted in a rotation-free fashion on the cutter slide. In both cases the aforementioned rotation takes place appropriately with the help of a computer-controlled stepping motor. In order fully to utilize the advantage of the new tool holder, it is applied preferably in conjunction with a turret magazine arranged for tool changing in accordance with the aforementioned SE 8604196-9. With this in view, the housing for the tool holder is divided into two halves along a plane passing through the axis of the housing. One half of the housing is thus supported for rotation about the aforementioned axis, whereas the other half is executed for tool changing in accordance with the aforementioned SE publication.

In order further to increase the tool capacity, the punch holder of the tool can also accommodate a central punch so arranged as to be activated separately as an alternative to one of the other eccentric punches. The tool holder is provided for this purpose with a tooth coupling, which can alternatively render the central punch ineffective when the impact heel is set in a position directly in line with a push-rod in the tool holder, or can activate the central punch when the impact heel is in a position between two push rods, whereby the eccentric punches are rendered ineffective.

The invention is described below in the form of illustrative embodiments and with reference to the accompanying drawings.

Identical parts and corresponding parts have the same reference designations in the Figures.

Figure 1:
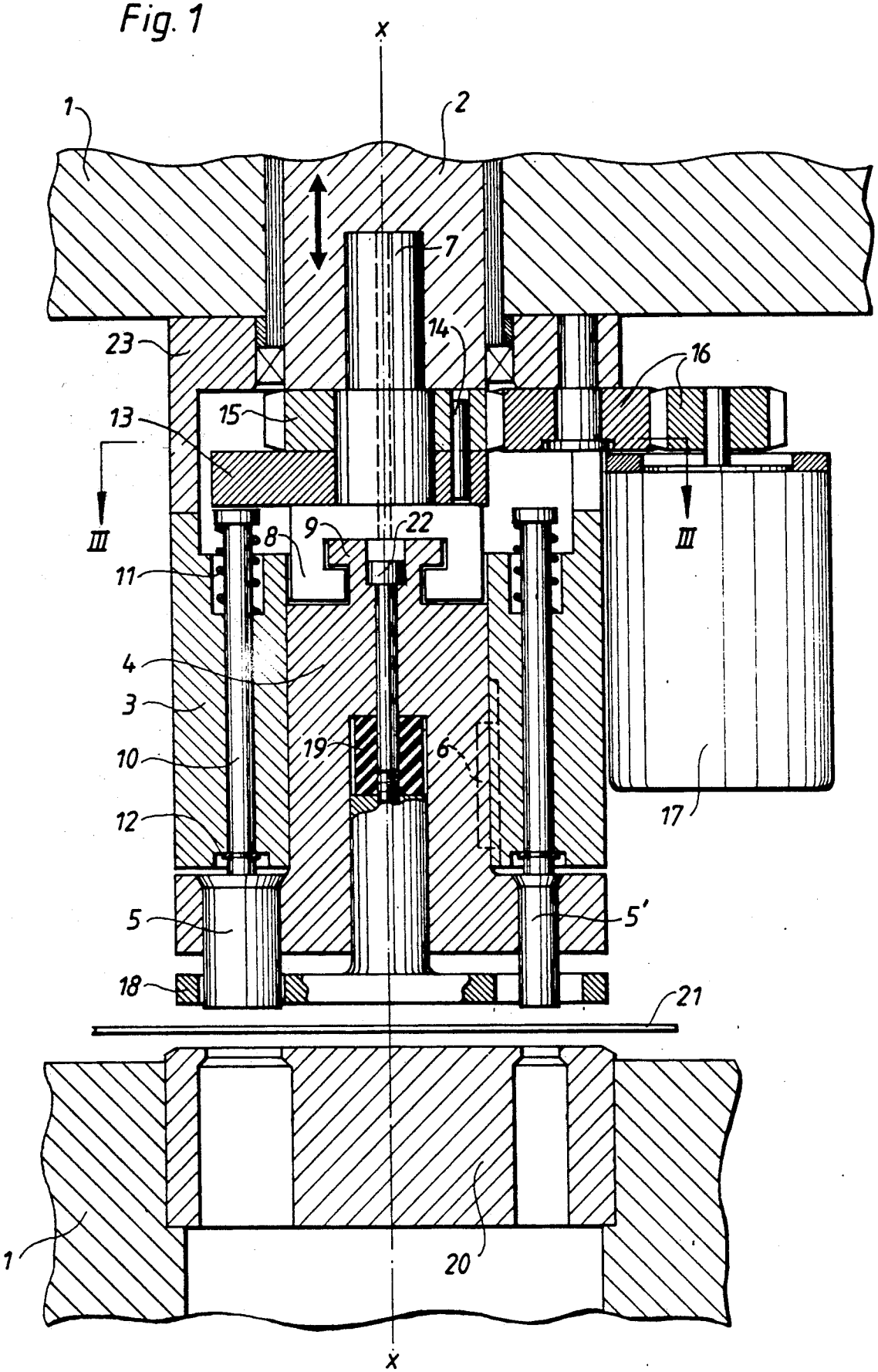
FIG. 1 is an axial section through the tool holder with a punch holder accommodated therein containing eccentric punches for interaction with corresponding die openings arranged in a die part.

Mounted in the frame 1 of a punching machine is a cutter slide 2 for axial movement vertically in the direction of the double arrow shown in FIG. 1. Arranged concentrically around the axis x—x of the cutter slide is a preferably essentially cylindrical housing 3 which, in accordance with the Figure, is securely connected to the upper part of the frame via a holder 23. The housing 3, which is split axially for installation reasons, accommodates and guides the axial movement of a punch holder 4. This punch holder is attached to the cutter slide by means of a pin 7 secured in the cutter slide, to which a driver 8 is connected. The driver has a 'T'-shaped groove 9, in which a correspondingly executed head on the punch holder 4 engages. The punch holder 4 accommodates punches 5, 5' capable of axial movement which are positioned eccentrically in relation to the axis x—x, preferably around a pitch circle with equal spacing between the punches. The punches are provided at their upper part with a projecting collar serving as a stop in conjunction with downward movement. The punch holder also accommodates a puller 18 in the form of a horizontal disc with openings for the respective punches and is guided centrally in the punch holder 4 for its axial movement therein. A spring buffer 19 serves in a manner already familiar from the prior art to force the puller compliantly against the workpiece during the operating stroke of the tool. The puller is maintained in an outer end position by means of a screw 22, the head of which constitutes a stop against the head of the punch holder. The punch holder is guided in a rotation-free fashion for axial movement inside the housing 3 by means of a guide taper 6.

A push-rod 10 extends directly in line with each punch. The push-rod is mounted in the housing in such a way as to be capable of axial movement parallel with the axis x—x and is maintained in an upper initial position in the housing 3 with the help of a spring 11, which is in contact with a stop on the upper part of the push-rod. A safety device 12 at the lower end of the rod limits its upward movement.

Pivotally mounted around the pin 7 is an impact heel 13, which is connected in a rotation-free fashion to a toothed wheel 15 with the help of a pin 14. The aforementioned toothed wheel is connected via a gear wheel 16 to a stepping motor 17. The impact heel is so arranged with the help of the stepping motor 17 as to be capable of adjustment to any desired rotational position about the axis x—x; in the embodiment in accordance with FIG. 1, it is thus directly in line with each push-rod 10. When in the position to which it has been adjusted in this way, free play of a few tenths of a millimeter is present between the impact heel and the push-rod at the upper end of the latter, and corresponding free play is present between the push-rod and each punch facing towards the push-rod.

Any other mechanical drive system which operates in steps can be used as an alternative to the stepping motor drive.

The punches interact with corresponding axially arranged die openings in a fixed die part 20 arranged in the frame 1 for the punching of the metal sheet 21.

The arrangement operates as follows.

Once the metal sheet 21 has been introduced between the punch part and the die part and has been placed in the desired position, for example with the help of a coordinate control device or similar apparatus which can be program-controlled, the stepping motor 17 is switched on in accordance with the operating program of the punching machine for the purpose of adjusting the impact heel 13 into position directly in line with a desired punch. The operating stroke of the machine is then triggered, when the cutter slide is caused to move downwards, and the punch 5 is pushed down through the metal sheet 21 by means of the impact heel and the push-rod 10. In conjunction with the downward movement of the cutter slide the punch holder 4 is carried parallel with the push-rod 10 and is guided by the guide taper 6 in such a way as to prevent rotation. The puller 18 is carried downwards at the same time at the punch holder 4 in a direction towards the metal sheet and is pushed against the metal sheet as the punch holder and the punch continue to travel downwards. The spring buffer 19 is compressed in conjunction with this. The punches 5', etc., which are not activated are pushed against the metal sheet during the downward movement of the punch holder and remain in that position during axial displacement in their guide relative to the punch holder The punch holder 4 is carried back as the cutter slide is returned by its head engaging in the 'T'-shaped groove 9 of the driver The punch 5 is pulled up and out of the metal sheet, whilst the puller 18 is still held pressed against the metal sheet 21 at the beginning of the return stroke by the spring buffer 19. The punch 5 is supported axially by its upper projecting edge part against the punch holder and is carried back in conjunction with its return movement. The other punches 5', etc., are returned with sliding control in the punch holder to their initial position in contact with the respective push-rod.

The toothed wheel 15 on the cutter slide is provided with straight-cut teeth, which extend parallel with the axis x—x so that the toothed engagement of the wheel with the gear wheel 16 does not obstruct its axial movement with the cutter slide.

Figure 3:
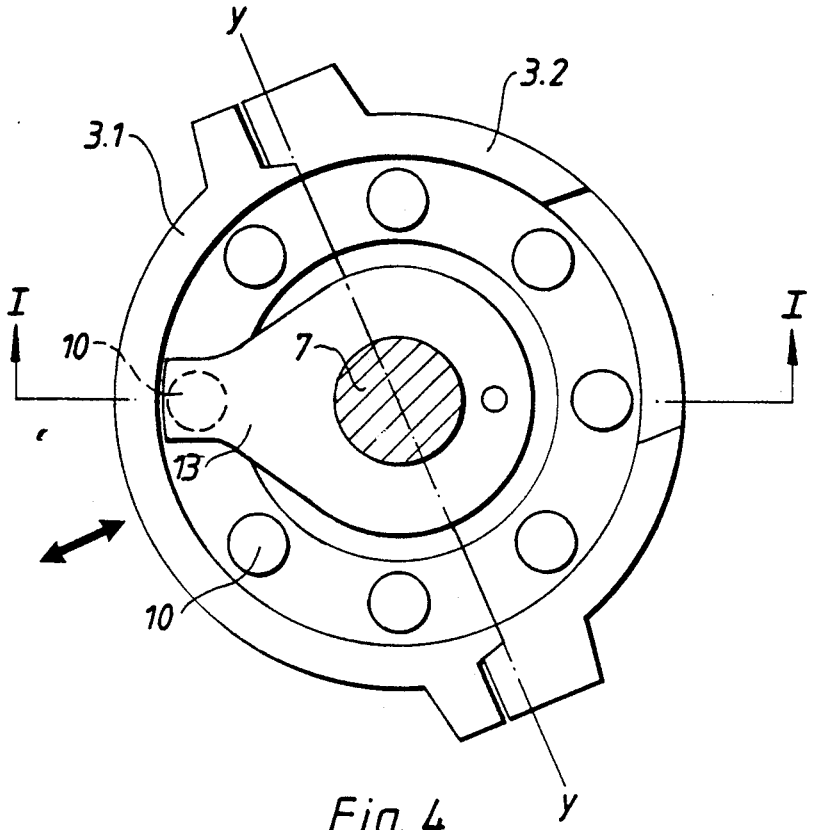
FIG. 3 is a section along the line III—III in FIGS. 1 and 2.

In order to permit the punch holder 4 to be installed in the Z housing 3 and to engage with the 'T'-shaped groove 9 of the driver, the housing is split in the manner which can be appreciated from FIG. 3. The parting line y—y between the two halves 3.1 and 3.2 of the housing extend diametrically through the common axis of the housing and the cutter slide.

In the embodiment described above the housing 3 with its associated push-rods 10 and punch holders 4 with punches 5, 5', as well as the die part 20, are fitted in a rotation-free fashion to the frame 1, whereas the impact heel 13 is free to rotate about the axis x—x of the cutter slide. It is, however, possible to achieve corresponding activation of selected punches by mounting the housing 3 and the die part 20 in such a way as to permit their synchronous rotation about the axis x—x, whilst the impact heel 13 is maintained in an unchanged rotational position on the cutter slide 2. This pivotal mounting of the housing and the die part can thus be executed as shown in the aforementioned SE 8604196-9. The stepping motor provides a synchronous drive and adjusts the housing and the die part to the desired rotational positions, such that a push-rod 10 with its associated punch is situated directly in line with the stationary impact heel. The driver 8 in this case is pivotally mounted in the cutter slide 2 so that it is able to follow the common rotational movement of the housing and the punch holder which is accommodated in a rotation-free fashion therein. It should be noted that the activated punch in this case will always operate in an unchanged position relative to the frame 1.

The housing, which is split and capable of rotation in accordance with the foregoing, can be used with advantage in combination with a turret magazine for tool changing, as described in greater detail in the aforementioned SE 8604196-9, to which reference is made. One of the halves of the housing in this case is mounted in a stationary fashion simply for the purpose of rotating about the axis x—x, whereas its second half is also capable of movement radially and perpendicularly to the parting line, as indicated by the double arrow in FIG. 3. The two halves of the housing are held together by locking devices with an automatic action, which permits the unimpeded rotation of the housing.

Figure 2:
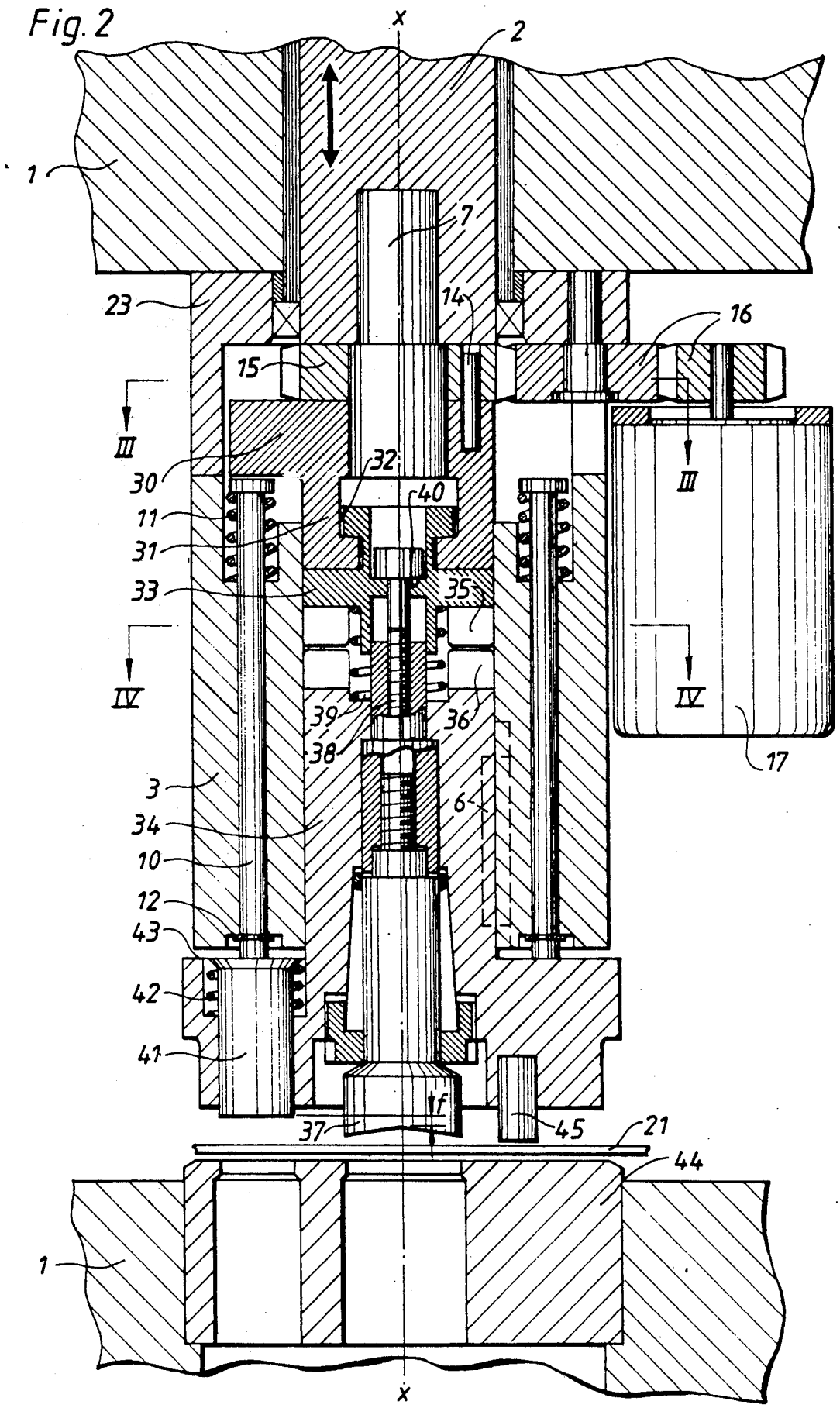
FIG. 2 is a similar axial section through a second embodiment, in which the punch holder also accommodates a central punch and coupling devices are arranged for the alternative activation of the central punches and the eccentric punches.

A further embodiment of the tool holder in accordance with the invention is shown in FIG. 2. In this case the punch holder 34 additionally contains a central punch 37 so arranged as to be adjusted as required for operation irrespective of the other eccentric punches 41, etc. In accordance with FIG. 2 the housing 3 is securely attached via a holder 23 to the frame 1, and the die part 44 is similarly securely attached to the frame. The punches 41, etc., are actuated similarly to those in the arrangement in accordance with FIG. 1, by means of push-rods 10 and an impact heel 30 pivotally attached to the cutter slide 2. The impact heel 30 is pivotally mounted, like the arrangement in accordance with FIG. 1, on a pin 7 which is securely accommodated in the cutter slide 2. The impact heel is connected by means of a pin 14 in a rotation-free fashion to a toothed wheel 15 with straight teeth in engagement with a gear transmission 16, which is driven from a stepping motor 17. The impact heel is thus capable of adjustment as required by means of the stepping motor directly in line with any of the push-rods 10 for the purpose of actuating a desired punch 41. The eccentric punches 41 have an upper projecting collar, as in the previous embodiment, against which in this case a spring 42 is in contact for the purpose of retaining the punch compliantly in an upper position against a stop 43. Elastic urethane elements 45 positioned between the punches are used as pullers, for example.

Figure 4:
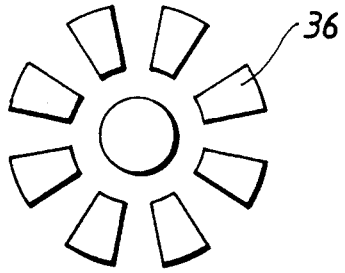
FIG. 4 is a diagrammatic section along the line IV—IV in FIG. 2, showing the tooth profile of the tooth coupling.
Figure 5:
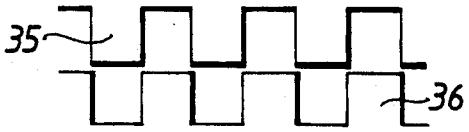
FIG. 5 shows in diagrammatic form the relative position of the interacting teeth of the tooth coupling with the central punch disengaged.

A central punch 37 is securely fitted in the punch holder 34. As in the previous embodiment, the punch holder is guided in a rotation-free fashion for axial movement inside the housing 3 with the help of a guide taper 6. The punch holder is so arranged by means of a toothed coupling as to be actuated, or not actuated as the case may be, for axial movement from the cutter slide 2. The toothed coupling includes teeth 36 executed on the upper part of the punch holder 34 for the purpose of interacting with teeth 35 executed on a coupling component 33. These coupling teeth 36 are shown in plan view in FIG. 4. The coupling component 33 engages in a 'T'-shaped groove in the driver 31, which is securely attached to the impact heel 30. Rotation of the impact heel 30 thus causes the driver 31, and with it the coupling component 33, to be rotated with their teeth 35 in relation to the punch holder 34 with its teeth 36. These teeth can now be made to adopt different relative rotational positions, namely a rotational position in accordance with FIG. 5 in which each tooth 35 on the coupling component 33 is directly in line with a gap between two teeth 36 on the punch holder 34, or a rotational position in accordance with FIG. 6, in which the teeth 35 and 36 are situated directly in line with one another. In the first mentioned rotational position in accordance with FIG. 5, an axial movement of the cutter slide 2 will not affect the punch holder, whereas an axial movement of the cutter slide 2 in the rotational position in accordance with FIG. 6 will produce corresponding axial displacement of the punch holder with the central punch 37.

The arrangement operates as follows.

In a first adjustment position the arrangement operates only with eccentric punches 41, etc. For this purpose the impact heel 30 is adjusted by means of the stepping motor 17 until it is directly in line with a push rod 10 attached to the corresponding desired punch. In this position the teeth 35, 36 of the toothed coupling are adjusted in relation to one another in accordance with FIG. 5, that is to say one tooth 35 engages between two teeth 36 on the punch holder 34 in conjunction with the axial displacement of the coupling component 33. The punch holder with its centrally securely accommodated punch 37 is moved compliantly in a downward direction against the effect of the spring 39 between the punch holder and the coupling component until the elastic puller elements 45 meet the metal sheet 21 in contact with the die part 44. Continued downward movement of the cutter slide simply results in the punch holder with the central punch 37 being maintained in an elastic fashion at a certain distance from the metal sheet, whilst the teeth 35 on the coupling component are introduced into the gap between the teeth 36 on the punch holder. A central axial screw 38 is screwed into the punch holder and with its head constitutes a stop 40 which limits the displacement of the coupling component in a direction away from the punch holder, but not towards it. During the continued downward movement of the cutter slide, the punch 41 is caused to move by the impact heel 30 and the push-rod 10 towards the metal sheet 21, and the stamping operation is executed whilst the punch holder is maintained by the sprung puller elements 45 in a compliant end position above the metal sheet. The punch 41 continues to move downwards whilst being guided inside the punch holder and with compression of the spring 42. The central punch 37 never comes into contact with the metal sheet. The return phase involves the working parts being returned with the help of the cutter slide 2, the spring 42 and the spring 39 to the position shown in FIG. 2.

Figure 6:
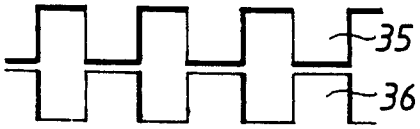
FIG. 6 shows the teeth of the tooth coupling in the position for the activation of the central punch.

In a second adjustment position only the central punch 37 is activated. For this purpose the impact heel 30 is adjusted to a position between a pair of push-rods, which are assumed to be distributed at regular spacing along a pitch circle around the axis x—x. The coupling is assumed to have the same number of teeth and gaps between the teeth as the number of push-rods, so that the coupling component 33 will have its teeth 35 adjusted to a position directly in line with the teeth 36 on the punch holder 34, as shown in FIG. 6, in every position of the impact heel 30 between two push-rods. On the downward operating stroke of the cutter slide, the punch holder 34 is now caused to move downwards together with the centrally accommodated punch 37 contained therein, by means of the pin 7 in contact with the coupling component and the coupling teeth 35 and 36 which are in contact with one another, in such a way as to execute the punching operation by interacting with a corresponding central die opening in the die part 44. As can be appreciated from FIG. 2, the central punch exhibits a linear projection f beyond the punch 41. This linear projection f is at least of the same dimension as the thickness of the metal sheet to be punched. The eccentric punch 41 does not project forwards as far as the metal sheet during the central punching operation. During the return stroke of the cutter slide, the punch holder 34 is kept pressed against the metal sheet 21 with the help of the elastic elements 45 only until the punch 37 has left the metal sheet. The punch holder is then returned to its initial position by the stop 40 on the screw 38 coming into contact with the coupling component 33.

The housing 3 is preferably split, as in the case of the embodiment in accordance with FIG. 1. As in the case described above, the arrangement can be executed with a rotation-free impact heel and with a pivotally arranged housing part and die part. The impact heel is arranged for this purpose on the parting line of the housing, with the 'T'-shaped groove 32 in the driver 31 facing perpendicularly towards the parting line. The moving housing part interacts with a turret magazine for tool changing, as previously described in more detail in the aforementioned SE 8604196-9.

I claim:

1. Tool holder for punching tools with punches capable of actuation as required intended for a punching machine, including a housing (3) which is essentially coaxial with a cutter slide (2) of the punching machine for the rotation-free accommodation and the axially movable control of a punch holder (4) connected to the cutter slide with a number of axially movable punches (5, 5') situated eccentrically around the axis (x—x) of the housing and so arranged as to be actuated individually so as to interact with die openings in a die part (20) adapted to the punches by means of a push-rod (10) arranged coaxially with each punch, which push-rod is in contact at one end with the punch and is so arranged at the opposite end as to be capable of connection to the cutter slide in such a way as to be caused to move in an axial sense with the cutter slide, characterized in that each push-rod (10) is supported in the housing (3) in such a way as to permit movement in parallel with the axis (x—x) of the housing, and in that the push-rod at its aforementioned opposite end is so arranged as to be connected to the cutter slide (2) in such a way as to permit movement in the direction of the operating stroke of the cutter slide by an impact heel (13) attached to the cutter slide and projecting radially from the cutter slide, which impact heel follows the axial movement of the cutter slide without exerting an eccentric force on the punch holder (4), wherein the impact heel and the housing are capable of rotating relative to one another about the common axis (x—x) of the housing and the cutter slide so as to permit the adjustment as required of the impact heel towards the aforementioned opposite end of the push-rod, and wherein the punch holder (34) also supports a punch (37) which is coaxial with the housing (3) and securely held in the punch holder, characterized by a coupling component (33) which is connected in a rotation-free fashion to the impact heel (30) and is incapable of movement in an axial sense, which coupling component is so arranged via tooth-coupling (35, 36) executed on the punch holder and the coupling component, as to engage axially with the punch holder (34) in a first rotated position which the teeth of the coupling component are positioned directly in line with corresponding teeth (36) on the punch holder, whilst the coupling component, when in a second rotated position, does not engage axially with the punch holder when the teeth (35, 36) of the tooth-coupling are directly in line with a corresponding gap in the teeth, wherein the impact heel (30) in the first rotated position is situated between two push-rods (10) without actuating them, and in the second position is situated directly in line with a push-rod in such a way as to actuate it.

2. Tool holder according to claim 1, characterized in that the impact heel (13) is pivotally connected to the cutter slide (2) about its axis (x—x), whereas the housing (3) is arranged in a rotation-free fashion on the frame (1) of the punching machine.

3. Tool holder according to claim 1, characterized in that the impact heel is connected in a rotation-free fashion to the cutter slide, whereas the housing is pivotally mounted on the frame of the punching machine about the axis (x—x) of the housing.

* * * * *